US008417386B2

(12) United States Patent
Douglas et al.

(10) Patent No.: US 8,417,386 B2
(45) Date of Patent: Apr. 9, 2013

(54) SYSTEM AND METHOD FOR DEFROST OF AN HVAC SYSTEM

(75) Inventors: Jonathan D. Douglas, Bullard, TX (US); Darryl E. Denton, Tyler, TX (US); Alan D. Marble, Whitehouse, TX (US); Kevin B. Mercer, Troup, TX (US); Gary L. Sapp, Tyler, TX (US); Kristen L. Schaefer, Tyler, TX (US); Steven A. Tice, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 449 days.

(21) Appl. No.: 12/272,513

(22) Filed: Nov. 17, 2008

(65) Prior Publication Data

US 2010/0125369 A1 May 20, 2010

(51) Int. Cl.
*G05D 23/00* (2006.01)
*F25D 21/00* (2006.01)
*F25D 21/06* (2006.01)

(52) U.S. Cl.
USPC ..... 700/276; 62/80; 62/115; 62/151; 62/156; 62/160

(58) Field of Classification Search ..... 700/276; 236/10, 14, 15 R; 62/80, 115, 150, 151, 62/156, 175, 188, 185
See application file for complete search history.

(56) References Cited

U.S. PATENT DOCUMENTS 4,158,950 A * 6/1979 McCarty ..... 62/278
4,302,947 A * 12/1981 Mueller et al. ..... 62/155
4,326,387 A 4/1982 Friedman
4,389,851 A * 6/1983 Chrostowski et al. ..... 62/81
4,407,138 A * 10/1983 Mueller ..... 62/126
4,441,335 A * 4/1984 Bonne ..... 62/324.6
4,467,613 A 8/1984 Behr et al.
4,519,214 A * 5/1985 Sano et al. ..... 62/156
4,528,821 A * 7/1985 Tershak et al. ..... 62/153
4,530,217 A * 7/1985 Alluto et al. ..... 62/156
4,563,877 A * 1/1986 Harnish ..... 62/80
4,627,484 A * 12/1986 Harshbarger et al. ..... 237/2 A
4,749,881 A 6/1988 Ulrich
4,760,709 A * 8/1988 Aoki et al. ..... 62/324.6
4,843,838 A * 7/1989 Trask ..... 62/324.6

(Continued)

OTHER PUBLICATIONS

Didion, D.A.; and Kelly, G.E., "New Testing and Rating Procedures for Seasonal Performance of Heat Pumps", Feb. 1979, Proceedings of the Carrier International Symposium on Heat Pumps and Space Conditioning for the 1990's.*

(Continued)

*Primary Examiner* — Mohammad Ali
*Assistant Examiner* — Kelvin Booker
(74) *Attorney, Agent, or Firm* — Conley Rose, P.C.; J. Robert Brown, Jr.

(57) ABSTRACT

A system and a method are provided for monitoring a condition and selectively executing a certification defrost algorithm for a heating, ventilation, and air conditioning (HVAC) system in response to the status of the monitored condition. A system and a method are provided for selectively operating a certification defrost algorithm in parallel to a field defrost algorithm. A system and a method are also provided for causing a controller to execute a first algorithm and for causing the controller to selectively execute a second algorithm while also executing the first algorithm where each of the first algorithm and the second algorithm are configured to selectively cause the HVAC system to operate in a defrost mode.

19 Claims, 7 Drawing Sheets

U.S. PATENT DOCUMENTS

| | | | | | |
|---|---|---|---|---|---|
| 4,920,756 | A | * | 5/1990 | Howland et al. | 62/173 |
| 4,974,420 | A | | 12/1990 | Kramer | |
| 5,025,640 | A | * | 6/1991 | Drucker | 62/324.6 |
| 5,138,844 | A | | 8/1992 | Clanin et al. | |
| 5,186,021 | A | * | 2/1993 | Keller | 62/511 |
| 5,267,443 | A | * | 12/1993 | Roehrich et al. | 62/50.3 |
| 5,276,630 | A | * | 1/1994 | Baldwin et al. | 700/276 |
| 5,315,840 | A | * | 5/1994 | Viegas et al. | 62/167 |
| 5,377,497 | A | | 1/1995 | Powell | |
| 5,440,891 | A | * | 8/1995 | Hindmon et al. | 62/117 |
| 5,440,895 | A | * | 8/1995 | Bahel et al. | 62/223 |
| 5,507,154 | A | | 4/1996 | Grant | |
| 5,524,444 | A | * | 6/1996 | Gromala et al. | 62/115 |
| 5,605,053 | A | | 2/1997 | Otori | |
| 5,743,099 | A | * | 4/1998 | Kraynak et al. | 62/150 |
| 5,765,382 | A | * | 6/1998 | Manning et al. | 62/154 |
| 5,842,355 | A | * | 12/1998 | Kalis et al. | 62/234 |
| 5,845,502 | A | * | 12/1998 | Chen et al. | 62/81 |
| 5,918,668 | A | * | 7/1999 | Trimble | 165/240 |
| 5,970,727 | A | | 10/1999 | Hiraoka et al. | |
| 6,021,644 | A | | 2/2000 | Ares et al. | |
| 6,082,128 | A | * | 7/2000 | Lake et al. | 62/324.6 |
| 6,089,034 | A | * | 7/2000 | Lake et al. | 62/204 |
| 6,092,376 | A | * | 7/2000 | Lake et al. | 62/133 |
| 6,118,099 | A | * | 9/2000 | Lake et al. | 219/202 |
| 6,181,538 | B1 | | 1/2001 | Yoo | |
| 6,216,479 | B1 | | 4/2001 | Elwood | |
| 6,331,925 | B1 | * | 12/2001 | Loprete et al. | 361/22 |
| 6,334,321 | B1 | * | 1/2002 | Said et al. | 62/155 |
| 6,378,315 | B1 | * | 4/2002 | Gelber et al. | 62/80 |
| 6,389,823 | B1 | * | 5/2002 | Loprete et al. | 62/89 |
| 6,434,957 | B1 | | 8/2002 | Nishizuka et al. | |
| 6,591,621 | B2 | * | 7/2003 | Loprete et al. | 62/160 |
| 6,606,870 | B2 | * | 8/2003 | Holmes et al. | 62/155 |
| 6,615,593 | B2 | * | 9/2003 | Thurman | 62/89 |
| 6,631,620 | B2 | * | 10/2003 | Gray et al. | 62/156 |
| 6,658,373 | B2 | | 12/2003 | Rossi et al. | |
| 6,842,650 | B2 | | 1/2005 | Bennett | |
| 6,851,270 | B2 | * | 2/2005 | Denvir | 62/234 |
| 6,968,295 | B1 | * | 11/2005 | Carr | 700/286 |
| 7,004,246 | B2 | * | 2/2006 | Gavula | 62/151 |
| 7,024,254 | B2 | | 4/2006 | Salsbury et al. | |
| 7,079,967 | B2 | | 7/2006 | Rossi et al. | |
| 7,130,719 | B2 | * | 10/2006 | Ehlers et al. | 700/276 |
| 7,222,494 | B2 | | 5/2007 | Peterson et al. | |
| 7,290,600 | B2 | * | 11/2007 | Gavula | 165/231 |
| 7,331,188 | B2 | * | 2/2008 | Quilliard et al. | 62/150 |
| 7,340,910 | B2 | * | 3/2008 | Thompson | 62/186 |
| 7,343,226 | B2 | * | 3/2008 | Ehlers et al. | 700/276 |
| 7,379,997 | B2 | * | 5/2008 | Ehlers et al. | 709/224 |
| 7,886,558 | B2 | * | 2/2011 | Wiggs | 62/282 |
| 7,895,850 | B2 | * | 3/2011 | Kitsch | 62/176.6 |
| 2003/0182952 | A1 | * | 10/2003 | Brooke | 62/180 |
| 2004/0254654 | A1 | * | 12/2004 | Donnelly et al. | 700/22 |
| 2005/0086955 | A1 | * | 4/2005 | Rafalovich et al. | 62/156 |
| 2005/0257558 | A1 | * | 11/2005 | Yoshioka et al. | 62/324.5 |
| 2007/0028635 | A1 | * | 2/2007 | Gleeson | 62/239 |
| 2007/0220911 | A1 | * | 9/2007 | Wightman | 62/222 |
| 2008/0041072 | A1 | * | 2/2008 | Seefeldt | 62/117 |
| 2008/0041081 | A1 | * | 2/2008 | Tolbert | 62/228.4 |
| 2008/0054082 | A1 | * | 3/2008 | Evans et al. | 236/91 D |
| 2009/0173091 | A1 | * | 7/2009 | Hu | 62/151 |
| 2009/0173092 | A1 | * | 7/2009 | Hu | 62/151 |
| 2009/0266091 | A1 | * | 10/2009 | Tolbert, Jr. | 62/115 |
| 2009/0277197 | A1 | * | 11/2009 | Gambiana et al. | 62/115 |
| 2010/0070086 | A1 | * | 3/2010 | Harrod et al. | 700/276 |
| 2010/0070907 | A1 | * | 3/2010 | Harrod et al. | 715/772 |
| 2010/0123016 | A1 | * | 5/2010 | Douglas et al. | 236/49.3 |
| 2010/0179703 | A1 | * | 7/2010 | Singh et al. | 700/291 |
| 2010/0186927 | A1 | * | 7/2010 | Gietzen | 165/47 |
| 2011/0126560 | A1 | * | 6/2011 | Wightman | 62/80 |
| 2011/0130887 | A1 | * | 6/2011 | Ehlers, Sr. | 700/296 |

OTHER PUBLICATIONS

Karg, R. and Krigger, J., "Specification of Energy-Efficient INstallation and Maintenance Practices for Residential HVAC Systems: White Paper", Jul. 2000, Consortium for Energy Efficiency.*

Mehaffey, J., "Improved Defrost Cycle for Heat Pump Systems and Comparisons of Heating Systems for Moderate Climates", Jan. 2008, Rev 12, Retrieved from the Internet on Jul. 12, 2012 at "www.gpsinformation.org/joe/heatpump2".*

Schliesing, J.S., "The Effect of Alternate Defrost Strategies on the Reverse-Cycle Defrost of an Air-Source Heat Pump", 1988, Thesis, Texas A&M University.*

Wang, Z.; Gu, J. and Lu, Z, "Experimental Research of Air Source Heat Pump Frosting and Defrosting in a Double Stage-Coupling Heat Pump", 2006, HVAC Technologies for Energy Efficiency, vol. IV-10-2.*

* cited by examiner

SYSTEM AND METHOD FOR DEFROST OF AN HVAC SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) are used in residential and/or commercial areas for heating and/or cooling to create comfortable temperatures inside those areas. These temperature controlled areas may be referred to as comfort zones. Comfort zones may comprise different zone conditions (i.e., temperature, humidity, etc.) and the locations in which the HVAC systems are installed or otherwise associated with for the purpose of performing heat exchange (sometimes referred to as an ambient zone) may also have different conditions. Both the zone conditions and the conditions of the location affect operation of the HVAC systems and, where the conditions are different, may result in otherwise substantially similar HVAC systems operating at different efficiencies. Some HVAC systems are heat pump systems. Heat pump systems are generally capable of cooling a comfort zone by operating in a cooling mode for transferring heat from a comfort zone to an ambient zone using a refrigeration cycle (i.e., Rankine cycle). When the temperature of an ambient zone in which a portion of an HVAC system is installed or otherwise associated with is colder than the temperature of a comfort zone with which the HVAC system is associated, the heat pump systems are also generally capable of reversing the direction of refrigerant flow (i.e., a reverse-Rankine cycle) through the components of the HVAC system so that heat is transferred from the ambient zone to the comfort zone (a heating mode), thereby heating the comfort zone.

One example of rating the heating energy efficiency of an HVAC system is the use of the Heating Season Performance Factor (HSPF) rating. To obtain a HSPF rating, the HVAC system is tested under prescribed conditions (i.e., certification conditions) to determine the efficiency at which it generates an energy output based on an energy input. The prescribed conditions generally involve very strict control over the zone conditions and the ambient conditions of the location of the installation of the HVAC system being tested. A higher HSPF rating is indicative of a more energy efficient HVAC system. The higher HSPF rating indicates that the HVAC system may be operated at a lower energy cost than an HVAC system having a lower HSPF rating.

In some cases where moisture is present in the cold ambient zone, the moisture condenses on the HVAC system (e.g., the components of the HVAC system). Accordingly, when the ambient temperature is below a freezing point, frost and/or ice may accumulate on the HVAC system. This accumulation of frost and/or ice is detrimental to the ability of the HVAC system to perform at its optimum energy efficiency. In order for the HVAC system to perform efficiently, the frost and/or ice on the HVAC system should be removed (e.g., defrosted). Accordingly, the HVAC systems that provide refrigerant-based heating are often configured to perform a defrost function whereby the components of the HVAC system that are at least partially covered in frost and/or ice are heated to melt the frost and/or ice performing the defrosting is achieved by reversing the direction of refrigerant flow from the direction of flow used in the heating mode. Specifically, the refrigerant flow is such that heat is transferred from the comfort zone to the ambient zone during the defrosting of the HVAC system components. The heat pump systems generally use a reversing valve for rerouting the direction of refrigerant flow between the compressor and the heat exchangers associated with the comfort zone and the ambient zone. This act of defrosting consumes energy that could be used to heat the comfort zone, and therefore, the benefit of defrosting must be carefully weighed against the alternative of simply allowing the HVAC system to operate at a less energy efficient state with the frost and/or ice buildup intact.

SUMMARY OF THE DISCLOSURE

In one embodiment, a method is provided that includes executing a field defrost algorithm, monitoring whether a condition meets a criteria, and executing a certification defrost algorithm in parallel with the field defrost algorithm in response to the condition meeting the criteria. The method further includes performing a certification defrost cycle if demanded by the certification defrost algorithm and performing a field defrost cycle if demanded by the field defrost algorithm.

In other embodiments, a method is provided for improving an efficiency rating of an HVAC system during certification. The method includes executing a field defrost algorithm and selectively executing a certification defrost algorithm in parallel with the field defrost algorithm.

In yet other embodiments, an HVAC system is provided that includes a controller configured to execute a first algorithm and the controller is also configured to selectively execute a second algorithm while also executing the first algorithm. Each of the first algorithm and the second algorithm are configured to selectively cause operation of the HVAC system in a defrost mode.

The various characteristics described above, as well as other features, will be readily apparent to those skilled in the art upon reading the following detailed description of the embodiments of the disclosure, and by referring to the accompanying drawings.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
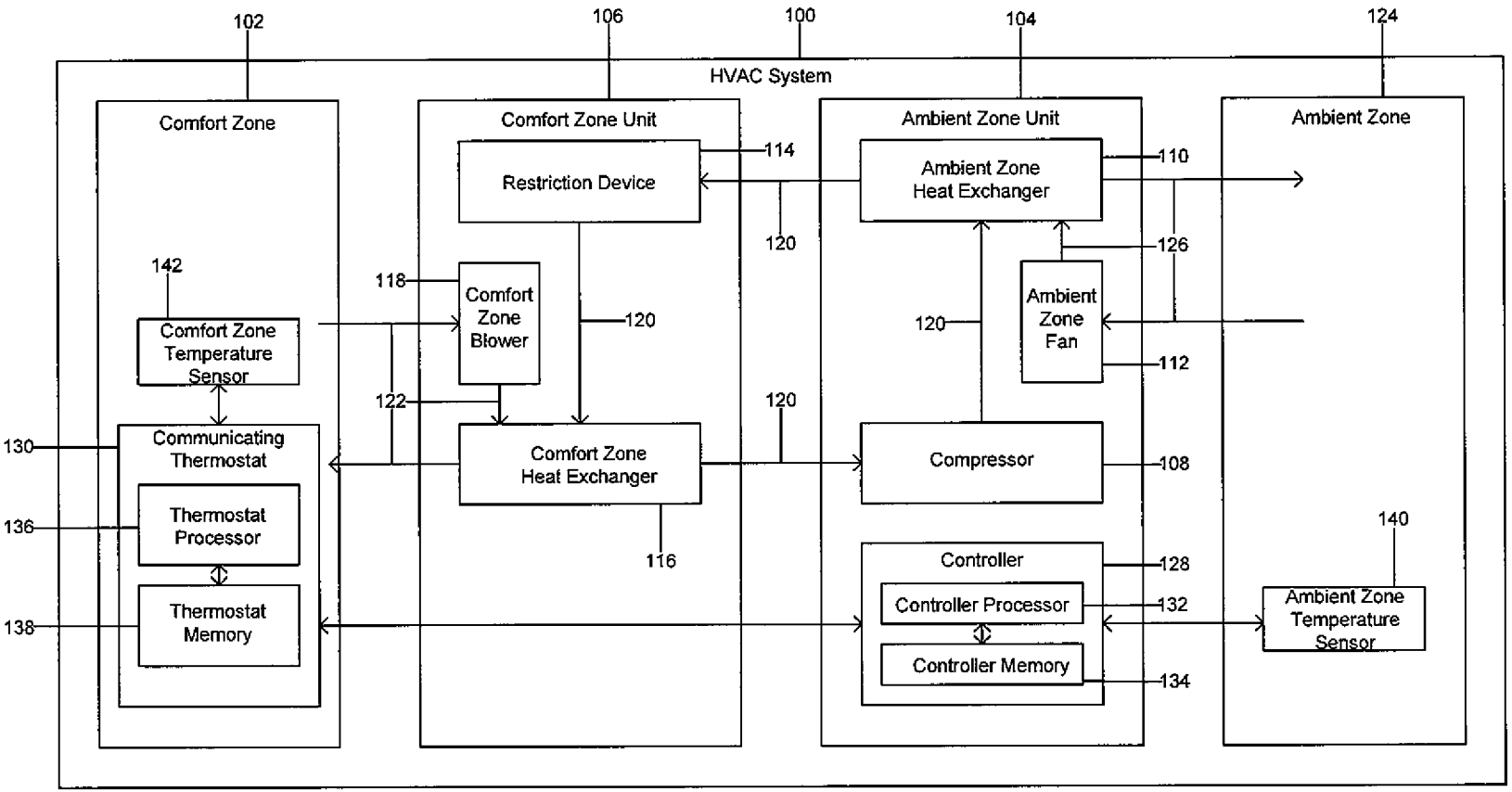
FIG. 1 is a simplified block diagram of an HVAC system according to embodiments of the disclosure.

FIG. 1 is a simplified schematic diagram of a heating/ventilation/air conditioning system 100 (hereinafter referred to as an "HVAC system 100") according to an embodiment. The HVAC system 100 operates to selectively control the temperature, humidity, and/or other air quality factors of a comfort zone 102. The HVAC system 100 generally comprises an ambient zone unit 104 and a comfort zone unit 106. The ambient zone unit 104 comprises a compressor 108, an ambient zone heat exchanger 110, and an ambient zone fan 112. The comfort zone unit 106 comprises a restriction device 114, a comfort zone heat exchanger 116, and a comfort zone blower 118. Refrigerant is carried between the compressor 108, the ambient zone heat exchanger 110, the restriction device 114, and the comfort zone exchanger 116 through refrigerant tubes 120.

The comfort zone blower 118 forces air from the comfort zone 102 into contact with the comfort zone heat exchanger 116, and subsequently back into the comfort zone 102 through air ducts 122. Similarly, the ambient zone fan 112 forces air from an ambient zone 124 into contact with the ambient zone heat exchanger 110 and subsequently back into the ambient zone 124 along an ambient air flow path 126. The HVAC system 100 is generally controlled by interactions between a controller 128 and a communicating thermostat 130. The controller 128 comprises a controller processor 132 and a controller memory 134 while the communicating thermostat 130 comprises a thermostat processor 136 and a thermostat memory 138.

Further, the controller 128 communicates with an ambient zone temperature sensor 140 while the communicating thermostat 130 communicates with a comfort zone temperature sensor 142. In this embodiment, communications between the controller 128 and the communicating thermostat 130, the controller 128 and the ambient zone temperature sensor 140, and the communicating thermostat 130 and the comfort zone temperature sensor 142 are capable of bidirectional communication. Further, communications between the controller processor 132 and the controller memory 134 and between the thermostat processor 136 and the thermostat memory 138 are capable of bidirectional communication. However, in alternative embodiments, the communication between some components may be unidirectional rather than bidirectional.

The HVAC system 100 is called a "split-system" because the compressor 108, the ambient zone heat exchanger 110, and the ambient zone fan 126 are colocated in the ambient zone unit 104 while the restriction device 114, comfort zone heat exchanger 116, and comfort zone blower 118 are colocated in the comfort zone unit 106 separate from the ambient zone unit 104. However, in alternative embodiments of an HVAC system, substantially all of the components of the ambient zone unit 104 and the comfort zone unit 106 may be colocated in a single housing in a system called a "package system." Further, in alternative embodiments, an HVAC system may comprise heat generators such as electrically resistive heating elements and/or gas furnace elements so that a comfort zone heat exchanger and the heat generators are both in a shared airflow path of a comfort zone blower.

While the comfort zone 102 may commonly be associated with a living space of a house or an area of a commercial building occupied by people, the comfort zone 102 may be also be associated with any other area in which it is desirable to control the temperature, humidity, and/or other air quality factors (i.e. computer equipment rooms, animal housings, and chemical storage facilities). Further, while the comfort zone unit 106 is shown as being located outside the comfort zone 102 (i.e. within an unoccupied attic or crawlspace), the comfort zone unit may alternatively be located within or partially within the comfort zone 102 (i.e. in an interior closet of a building).

Each of the ambient zone heat exchanger 110 and the comfort zone heat exchanger 116 may be constructed as air coils, shell and tube heat exchangers, plate heat exchangers, regenerative heat exchangers, adiabatic wheel heat exchangers, dynamic scraped surface heat exchangers, or any other suitable form of heat exchanger. The compressor 108 may be constructed as any suitable compressor, for example, a centrifugal compressor, a diagonal or mixed-flow compressor, an axial-flow compressor, a reciprocating compressor, a rotary screw compressor, a rotary vane compressor, a scroll compressor, or a diaphragm compressor. In this embodiment, the compressor 108 is capable of operating in multiple stages (e.g., stage A and stage B). For example, the compressor 108 can be operated at a low speed (stage A) or a high speed (stage B). Alternative embodiments of an HVAC system may comprise more than one compressor and the compressors may be operable at more than one speed or at a range of speeds (i.e., a variable speed compressor).

Further, while the HVAC system 100 is shown as operated in a cooling mode to remove heat from the comfort zone 102, the HVAC system 100 is configured as a "heat pump" system that selectively allows flow of refrigerant in the direction shown in FIG. 1 to cool the comfort zone 102 or in the reverse direction to that shown in FIG. 1 to heat the comfort zone 102 in a heating mode. It will further be appreciated that in alternative embodiments, a second restriction device substantially similar to restriction device 114 may be incorporated into an ambient zone unit to assist with operation of an HVAC system in a heating mode substantially similar to the heating mode of HVAC system 100.

In the cooling mode, the compressor 108 operates to compress low pressure gas refrigerant into a hot and high pressure gas that is passed through the ambient zone heat exchanger 110. As the refrigerant is passed through the ambient zone heat exchanger 110, the ambient zone fan 112 operates to force air from the ambient zone 124 into contact with the ambient zone heat exchanger 110, thereby removing heat from the refrigerant and condensing the refrigerant into high pressure liquid form. The liquid refrigerant is then delivered to the restriction device 114. Forcing the refrigerant through the restriction device 114 causes the refrigerant to transform into a cold and low pressure gas. The cold gas is passed from the restriction device 114 into the comfort zone heat exchanger 116. While the cold gas is passed through the comfort zone heat exchanger 116, the comfort zone blower 118 operates to force air from the comfort zone 102 into contact with the comfort zone heat exchanger 116, heating the refrigerant and thereby providing a cooling and dehumidifying effect to the air, which is then returned comfort zone 102. In this embodiment, the HVAC system is using a vapor compression cycle, namely, the Rankine cycle. In the heating mode, generally, the direction of the flow of the refrigerant is reversed (compared to that shown in FIG. 1) so that heat is added to the comfort zone 102 using a reverse-vapor compression cycle, namely, the reverse-Rankine cycle. It will be appreciated that alternative embodiments of an HVAC system may use any other suitable thermodynamic cycle for transferring heat to and/or from a comfort zone.

Generally, the controller 128 communicates with the ambient zone temperature sensor 140 that is located in the ambient zone 124 (i.e. outdoors, outdoors within the ambient zone unit in an embodiment where the ambient zone unit is located in the ambient zone, adjacent the ambient zone unit in an embodiment where the ambient zone unit is located in the ambient zone, or any other suitable location for providing an ambient zone temperature or a temperature associated with the ambient zone). While the controller 128 is illustrated as positioned within the ambient zone unit 104, in alternative embodiments, the controller 128 may be positioned adjacent to but outside an ambient zone unit, outside a comfort zone, within a comfort zone unit, within a comfort zone, or at any other suitable location. It will be appreciated that in alternative embodiments, an HVAC system may comprise a second controller substantially similar to controller 128 and that the second controller may be incorporated into a comfort zone unit substantially similar to comfort zone unit 106. In the embodiment shown in FIG. 1, through the use of the controller processor 132 and the controller memory 134, the controller 128 is configured to process instructions and/or algorithms that generally direct the operation of the HVAC system 100.

Generally HVAC systems such as 100 comprise processors such as 132 and 136 that control the operation of the HVAC systems. The processors are sometimes programmed or otherwise configured to control the operation of defrosting the HVAC components using a field defrost algorithm whereby the processors sense the presence of frost and/or ice or otherwise determine that a component of the HVAC system should be defrosted. The HVAC systems with processors that adaptively control and/or otherwise react to ambient zone 124 conditions are not well suited for acquiring the highest possible HSPF rating when the processors are programmed and operate as described above for field defrost. Accordingly, there is a need for an HVAC system 100 that can both adaptively respond to the need to defrost components of the HVAC system 100 and perform at optimal energy efficiency while in the controlled zones of a HSPF testing facility.

The present disclosure is directed to methods of controlling an HVAC system 100 and is directed to HVAC systems configured to be controlled by those methods. The disclosed methods may increase the efficiency (e.g., HSPF) rating of an HVAC system 100. The disclosed methods allow the HVAC system 100 to control defrosting of components of the HVAC system 100 such as ambient zone heat exchanger 110, refrigerant lines 120, and ambient zone fan 112 by executing a certification defrost algorithm in parallel to a field defrost algorithm. The field defrost algorithm operates to initiate one or more field defrost cycles suitable for defrosting the HVAC system 100 based on actual field operating conditions while the HVAC system 100 is being used in the field (i.e., installed and used for a purpose other than for use during a HSPF certification process). The certification defrost algorithm selectively causes the HVAC system 100 to perform one or more certification defrost cycles during the HSPF certification procedure. More specifically, the certification defrost algorithm selectively controls the HVAC system 100 to perform a certification defrost cycle when the certification defrost algorithm determines that the HVAC system 100 is being operated under conditions indicative of the predetermined HSPF certification testing conditions.

In this embodiment, the certification defrost algorithm is executed in parallel with the field defrost algorithm so that the field defrost algorithm is executed even while the certification defrost algorithm is executed. The certification defrost algorithm provides that the certification defrost algorithm may be terminated and/or exited, thereby allowing the HVAC system 100 to thereafter execute field defrost algorithm without the certification defrost algorithm being executed.

Figure 2:
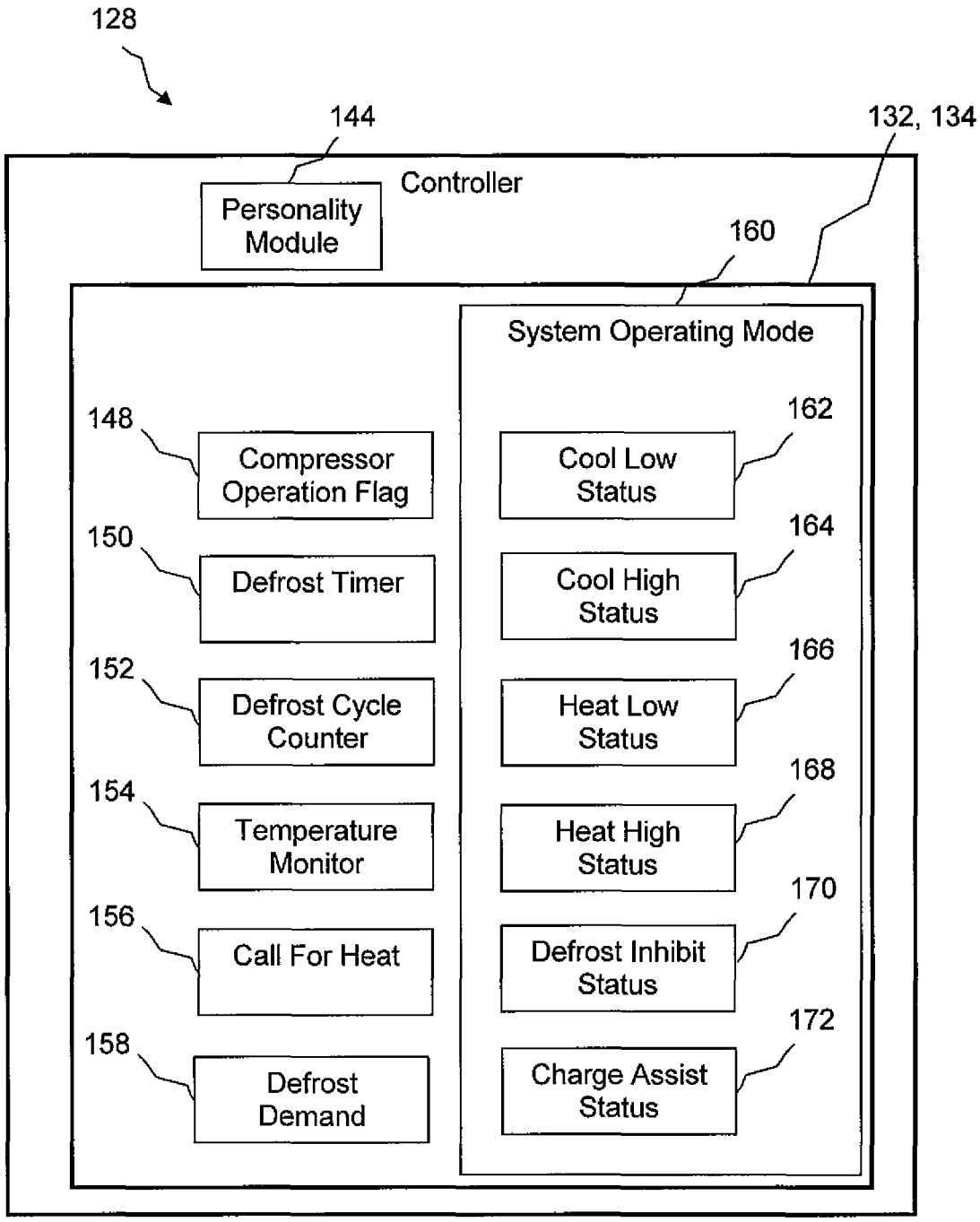
FIG. 2 is a simplified block diagram of a controller of the HVAC system of FIG. 1 according to embodiments of the disclosure.

Referring now to FIG. 2, the controller 128 is shown in greater detail. The controller 128 is used to control the different components of the HVAC system 100. The controller 128 further comprises a personality module 144 that stores information about the HVAC system 100 and the components thereof. The controller 128 retrieves information stored on the personality module 144 and gives instructions to the controller processor 132 and controller memory 134 based on the information provided by the personality module 144. The controller processor 132 and controller memory 134 comprise and/or operate to provide any necessary logical state indicators, keys, memories, timers, flags, counters, pollers, monitors, callers, and status indicators for processing and/or performing any programs, instructions, and/or algorithms provided to the controller 128.

The controller 128 comprises a plurality of algorithm status variables, stored variables, and timers, specifically, a compressor operation flag 148, a defrost timer 150, a defrost cycle counter 152, a temperature monitor 154, a call for heat 156, a defrost demand 158, and a system operating mode 160. The compressor operation flag 148 stores and provides information on whether the compressors 108 is being held (e.g., "HeldOff") for a different application or algorithm. While the compressors 108 are being held and the compressor operation flag is in a HeldOff state, the compressor operation flag 148 yields a negative result and the compressors 108 are not available for performing a defrost function. The defrost timer 150 stores and provides information on the length of time (e.g., in seconds, minutes, hours, etc.) since the beginning of the most recent certification defrost cycle (a defrost cycle initiated due to the certification defrost algorithm). The defrost timer 150 also stores and provides information on the defrost duration and the length of time each certification defrost cycle is programmed to last from start to finish, which is adjustable. For example, the defrost duration may be set to a period of about 30 minutes, 15 minutes, 5 minutes, or any other length of time suitable for defrosting HVAC system 100 components. The defrost cycle counter 152 stores information on the number of total defrost cycles that have occurred due to the certification defrost algorithm (as opposed to defrost cycles occurring due to the field defrost algorithm). If no certification defrost cycles have been executed, the defrost cycle counter 152 remains set at a value of zero. In this embodiment, the certification defrost algorithm may cause up to three certification defrost cycles. However, alternative embodiments of a certification defrost algorithm may cause more or fewer than three certification defrost cycles to occur. Specifically, the number of certification defrost cycles allowed by an alternative embodiment of a certification defrost cycle may be dependent upon on the particular HVAC system it is controlling so that the HVAC system may run more efficiently during certification testing. The temperature monitor 154 stores and provides information on the temperature of the ambient zone 124 that is obtained from the ambient zone temperature sensor 140. The temperature monitor 154 is configurable to represent and/or store temperatures in degrees Fahrenheit (° F.), degrees Celsius (° C.), Kelvin (K), or degrees Rankine (° R). The call for heat 156 stores and provides information on whether there is a request for heat and how long the current call for heat has endured. For example, the call for heat 156 yields a positive result indicating that there is currently a call for heat when the HVAC system 100 is requested to keep the comfort zone 102 at a particular temperature that is higher than a current temperature of the comfort zone 102. The defrost demand 158 stores and provides information on whether there is a request to defrost. For example, the defrost demand 158 yields a positive result when the HVAC system 100 is responding to a predetermined level of accumulation of frost and/or ice on the ambient zone heat exchanger 110 or other HVAC system 100 components.

Still referring to FIG. 2, the controller 128 operates to select a system operating mode 160 as indicated by a cool low status 162, a cool high status 164, a heat low status 166, a heat high status 168, a defrost inhibit status 170, and a charge assist status 172. The cool low status 162 yields a positive result when the HVAC system 100 is being operated in a low speed cooling mode (stage A cooling) where the HVAC system 100 operates to cool the comfort zone using a cooling rate lower than the highest cooling rate the HVAC system 100 is capable of providing. The cool high status 164 yields a positive result when the HVAC system 100 is being operated in a high speed cooling mode (stage B cooling) where the HVAC system 100 operates to cool the comfort zone 102 using a cooling rate higher than the cooling rate of the low cooling mode. In this embodiment, the compressor 108 is operated at a higher speed in the high cooling mode than the speed of the compressor 108 during operation in the low cooling mode. The heat low status 166 yields a positive result when the HVAC system 100 is being operated in a low speed heating mode (stage A heating) where the HVAC system 100 operates to heat the comfort zone 102 at a heating rate lower than the highest heating rate the HVAC system 100 is capable of providing. The heat high status 168 yields a positive result when the HVAC system 100 is being operated in a high speed heating mode (stage B heating) where the HVAC system 100 operates to heat the comfort zone 102 using a heating rate higher than the heating rate of the low heating mode. In this embodiment, the compressor 108 is operated at a higher speed in the high heating mode than the speed of the compressor 108 during operation in the low heating mode. The ambient zone fan 112 speed may or may not also change operation between high and low speeds and heating or cooling modes. The defrost inhibit status 170 stores and provides information on whether the components of the HVAC system 100 are being inhibited from being defrosted. For example, the defrost inhibit status 170 yields a positive result when the HVAC system 100 is prevented from executing either a field defrost cycle and/or a certification defrost cycle. The charge assist status 172 stores and provides information on whether there is a need to add refrigerant to the refrigerant tubes 120 and/or the components joined by the refrigerant tubes 120.

Generally, the HVAC system 100 is configured to execute a field defrost algorithm while also executing a certification defrost algorithm (described herein). Even while the field defrost algorithm is being executed, the HVAC system 100 is configured to selectively execute the certification defrost algorithm. While the HVAC system 100 executes both algorithms, the HVAC system 100 may be caused by either one of the algorithms to enter a defrost mode. In other words, the algorithms are run in parallel with each other and do not prevent each other from causing the HVAC system 100 to enter a defrost mode.

Figure 3:
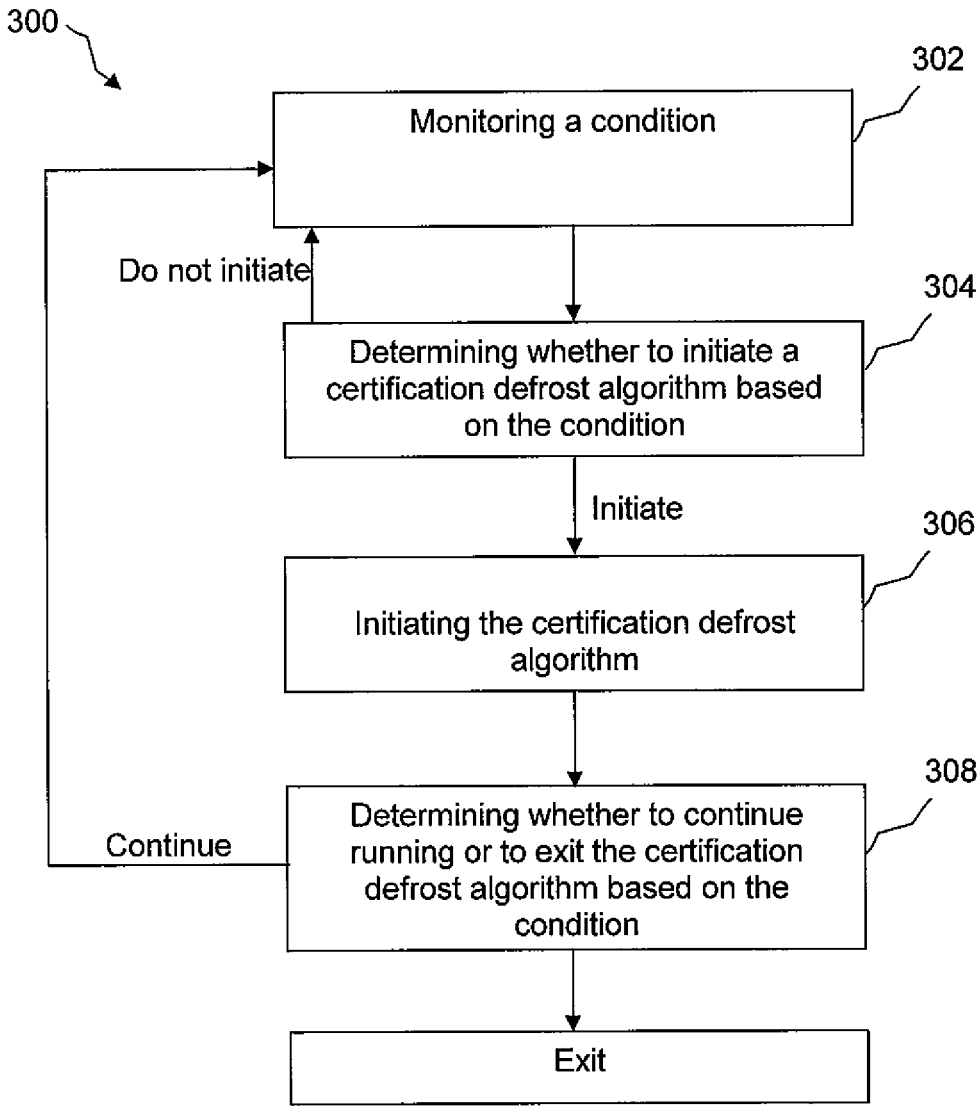
FIG. 3 is a schematic flow chart that illustrates a method of operating the HVAC system of FIG. 1 according to the disclosure.

Referring now to FIG. 3, a flow chart illustrating a method 300 of controlling the ambient zone unit 104 of the HVAC system 100 is shown. At block 302, a condition is monitored. The method 300 proceeds to block 304 where the method 300 determines whether to execute a certification defrost algorithm in response to the status of the condition monitored in block 302. If the monitored condition is determined to meet one or more predetermined certification conditions, the method 300 proceeds to block 306, where a certification defrost algorithm is initiated in parallel to a field defrost algorithm. If the monitored condition does not meet one or more predetermined certification conditions, the certification defrost algorithm is not initiated, it returns to monitoring conditions, and the field defrost algorithm continues to run. The one or more predetermined certification conditions are described later herein. Upon completion of defrost, the method 300 proceeds to block 308 where the method 300 determines whether to continue executing or to exit the certification defrost algorithm based on the monitored condition.

Figure 4A:
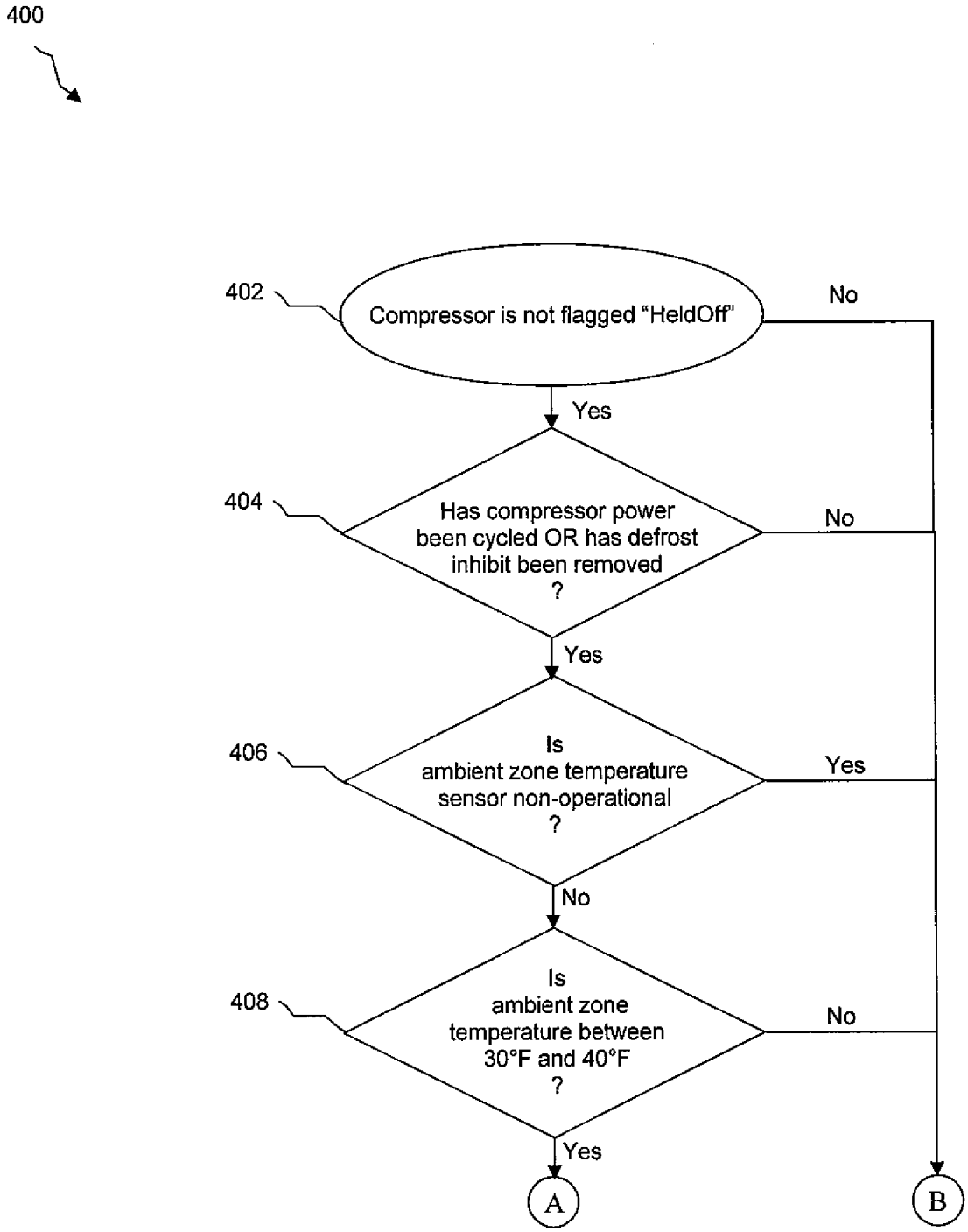
FIGS. 4A-4C comprise a flow chart that illustrates an alternative method of operating the HVAC system of FIG. 1.
Figure 4B:
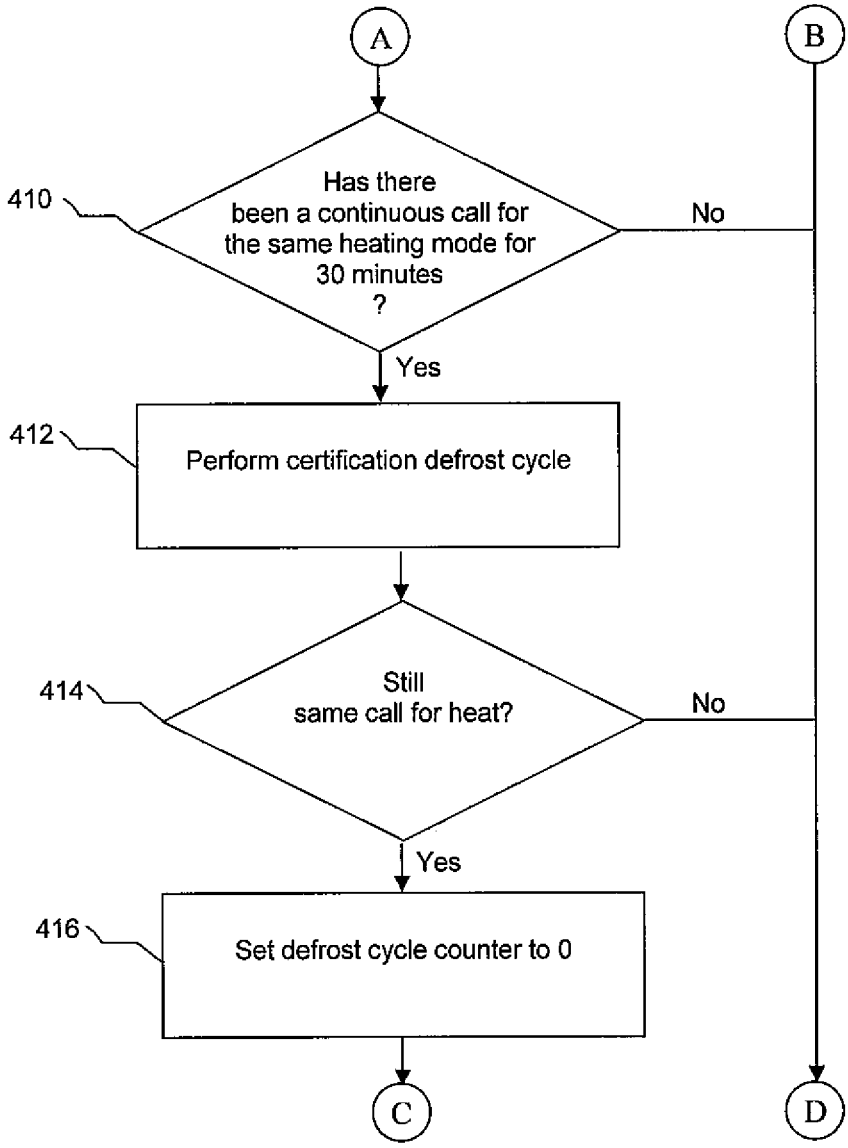
Figure 4C:
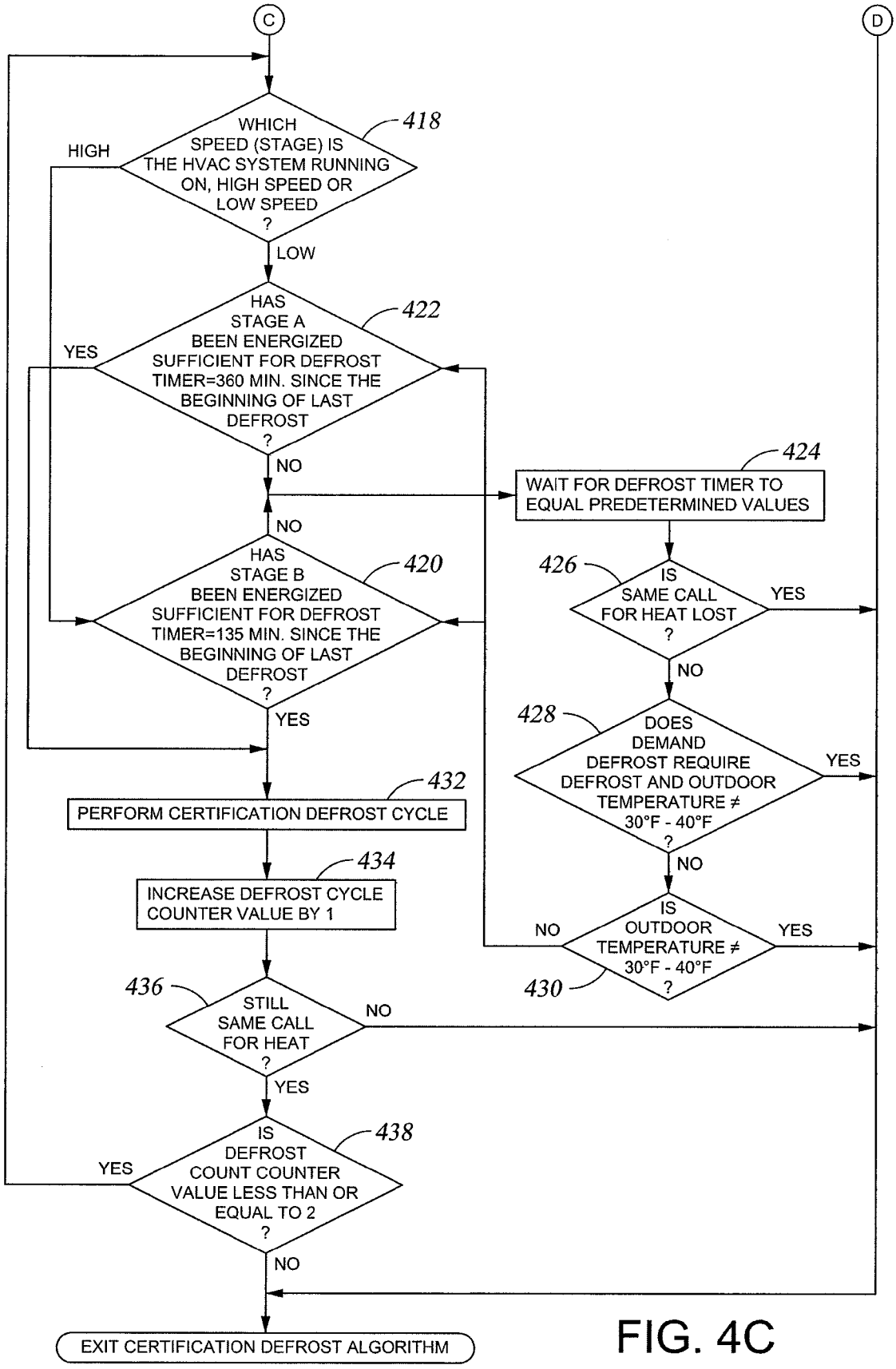

Referring now to FIGS. 4A-4C, a flow chart illustrating an alternative embodiment of a method 400 of controlling the HVAC system 100 is shown. The method 400 selectively causes the HVAC system 100 to perform certification defrost cycles during certification testing of the HVAC system 100. The HVAC system 100 starts the method 400 periodically with specified entrance conditions in block 402, which determines whether the compressor operation flag 148 yields a positive result (indicating that the compressor is not flagged "HeldOff" or otherwise prevented from being controlled by the method 400).

If the conditions of block 402 are met, the method 400 proceeds to decision block 404. Block 404 determines whether the power supplied to the compressor 108 has been cycled (turned off and then back on) and whether the defrost inhibit status 170 has changed to yield a negative result (indicating that the HVAC system 100 is no longer prevented from performing a defrost cycle). If neither the power supplied to the compressor 108 has been cycled nor has the defrost inhibit status 170 been changed to yield a negative result, the method 400 exits the certification defrost algorithm. If one of the conditions of block 404 is satisfied, the method continues to decision block 406.

At decision block 406, the method 400 uses the temperature monitor 154 to determine whether the ambient zone temperature sensor 140 is non-operational or faulted. If the temperature monitor 154 indicates that the ambient zone temperature sensor 142 is non-operational or faulted, the method 400 exits the certification defrost algorithm. In an alternative embodiment of controlling an HVAC system, if a communicating thermostat is present, the alternative method may send an alert to the communicating thermostat to notify a user that the ambient zone temperature sensor 140 is non-operational or is faulted, prompting the user to reset or replace the ambient zone temperature sensor 140 if necessary. If the temperature monitor 154 indicates that the ambient zone temperature sensor 140 is operational, the method 400 proceeds to decision block 408

At decision block 408, the method 400 determines whether the temperature monitor 154 reports that the ambient zone 124 temperature is within a range of from about 30° F. to about 40° F. In an alternative embodiment, the temperature range may be different. For example, in an alternative embodiment, the temperature range may be from a low temperature in a range of about 30° F. to 34° F. to a high temperature in a range of about 34° F. to about 40° F. If the temperature monitor 154 reports that the ambient zone 124 temperature is not within the range in question, the method 400 exits the certification defrost algorithm. If the temperature monitor 154 reports that the ambient zone 124 temperature is within the range in question, the method 400 proceeds to decision block 410.

At decision block 410, the method 400 determines whether there has been a continuous call for the same heating mode for 30 consecutive minutes. The information needed to make this determination is provided by the call for heat 156, the heat low status 166, and the heat high status 168. If the call for heat 156 reports a positive result but also reports that the same call for heat has not lasted continuously at least 30 minutes, the method 400 does not interfere with the current function of the heating mode, but rather repeats block 410 until the time is met. If the call for heat 156 reports that the call for heat status has been positive consecutively in the last 30 minutes but that the heating mode has changed between high and low heating modes or that the call for heat status has otherwise not been continuous, the method 400 does not interfere with the current function of the heating mode, but rather exits the certification defrost algorithm. However, if the call for heat has been a positive result for at least 30 consecutive minutes in the last 30 minutes and the heating mode has not changed during those 30 minutes, the method 400 proceeds to block 412.

At block 412, the method 400 causes the HVAC system 100 to perform a certification defrost cycle. It will be appreciated that in order to perform the certification defrost cycle, the defrost timer 150 is first reset and then monitors the duration of the certification defrost cycle and contributes to causing the certification defrost cycle to run for the period of time specified by the defrost timer 150. Once the certification defrost cycle has completed, the method 400 proceeds to decision block 414.

At decision block 414, the method 400 polls the call for heat 156 to determine whether the same call for heat remains. If there is no call for heat (call for heat 156 yields a negative result) or if there is a call for heat but the stage of heating has changed, the method 400 exits the certification defrost algorithm. If after the certification defrost cycle of block 412, there is still a call for heat (call for heat 156 yields a positive result) and the call for heat is the same stage of heating (stage A or stage B), the method 400 proceeds to block 416.

At block 416, the defrost cycle counter 152 is initialized and set to a value of zero. Next, at block 418, the method 400 determines whether the HVAC system 100 is being operated in a low heating mode or high heating mode (stage A or stage B heating). It will be appreciated that the heat low status 166 and the heat high status 168 of the system operating mode 160 provide the necessary information regarding whether the HVAC system 100 is being operated in a low speed (stage A) or a high speed (stage B). If the HVAC system 100 is running on the high heating mode, the method 400 proceeds to decision block 420. If the HVAC system 100 is running on the low heating mode, the method 400 proceeds to block 422.

At block 420, the method 400 determines whether the high heating mode (stage B) has been active for 135 minutes since the previous defrost cycle as reported by the defrost timer 150. If the defrost timer 150 does not report that the high heating mode (stage B) has been active for 135 minutes since the previous defrost cycle, the method proceeds to block 424 where the HVAC system 100 continues to run. As the HVAC system continues to run, the method 400 proceeds to block 426 where the method 400 determines whether the call for heat is lost or remains the same as before, reported by call for heat 156. If the call for heat is no longer present or is not the same speed, the method 400 exits the certification defrost algorithm.

If the call for heat is still present, the method 400 proceeds to block 428 where the method 400 determines whether the field defrost algorithm is calling for a field defrost cycle and whether the ambient temperature is between 30° F. and 40° F. (the range defined in block 408). If the field defrost algorithm is calling for a field defrost cycle and the ambient temperature is not between 30° F. and 40° F., the method 400 exits the certification defrost algorithm. Otherwise, if both of those conditions are not met, the method 400 proceeds to block 430. At block 430, the method 400 determines whether the ambient temperature is between 30° F. and 40° F. If the ambient temperature is not between 30° F. and 40° F., the method 400 exits the certification defrost algorithm. Ultimately, if the required conditions of blocks 426, 428, and 430 are not met (thereby not exiting the certification defrost algorithm), the method 400 returns to block 420. If the conditions are proper, the method 400 continues looping through blocks 420, 424, 426, 428, and 430 until the defrost timer 150 reports that stage B heating or high heating mode has been active for 135 minutes since the last defrost cycle. When block 420 determines that the defrost timer 150 indicates that high heating mode has been active for 135 minutes, the method 400 proceeds to block 432. It will be appreciated that in alternative embodiments of a method of controlling an HVAC system, a block of substantially similar function to block 420 may instead be configured to determine whether any other suitable period of time has elapsed. Particularly, the alternative block similar to block 420 may be configured to determine whether the elapsed time is any length of time within a range of about 90-180 minutes.

At block 422, the method 400 determines whether the low heating mode (stage A) has been active for 360 minutes since the previous defrost cycle as reported by the defrost timer 150. If the defrost timer 150 does not report that the low heating mode (stage A) has been active for 360 minutes since the previous defrost cycle, the method proceeds to block 424 where the HVAC system 100 continues to run. As the HVAC system 100 continues to run, the method 400 proceeds to block 426 where the method 400 determines whether the call for heat is lost or remains the same as before, reported by call for heat 156. If the call for heat is no longer present or is not the same speed, the method 400 exits the certification defrost algorithm.

If the call for heat is still present, the method 400 proceeds to block 428 where the method determines whether the field defrost algorithm is calling for a field defrost cycle and whether the ambient temperature is between 30° F. and 40° F. (the range defined in block 408. If the field defrost algorithm is calling for a field defrost cycle and the ambient temperature is not between 30° F. and 40° F., the method 400 exits the certification defrost algorithm. Otherwise, if both of those conditions are not met, the method 400 proceeds to block 430. At block 430, the method 400 determines whether the ambient temperature is between 30° F. and 40° F. If the ambient temperature is not between 30° F. and 40° F., the method 400 exits the certification defrost algorithm. Ultimately, if the required conditions of blocks 426, 428, and 430 are not met (thereby not exiting the certification defrost algorithm), the method 400 returns to block 422. If the conditions are proper, the method 400 continues looping through blocks 422, 424, 426, 428, and 430 until the defrost timer 150 reports that stage A heating or low heating mode has been active for 360 minutes since the last defrost cycle. When block 422 determines that the defrost timer 150 indicates that low heating mode has been active for 360 minutes, the method 400 proceeds to block 432. It will be appreciated that in alternative embodiments of a method of operating an HVAC system, at a block of substantially similar function to block 422 may instead be configured to determine whether any other suitable period of time has elapsed. Particularly, the alternative block similar to block 422 may be configured to determine whether the elapsed time is any length of time within a range of about 240-375 minutes.

At block 432, the method 400 causes the HVAC system 100 to perform a certification defrost cycle. Once the certification defrost cycle has completed, the method 400 proceeds to block 434 where the method increases the value of the defrost counter by 1 (one). Next, the method 400 proceeds to block 436 where the method 400 determines if the same call for heat continues to be present. The block 436 determines whether the same call for heat is present in substantially the same way as block 414. If block 436 determines that the same call for heat is not present, the method 400 exits the certification defrost algorithm. If block 436 determines that there is still the same call for heat as reported by call for heat 156, the method 400 proceeds to decision block 438.

At decision block 438, the method 400 determines whether the defrost cycle count, as reported by the defrost cycle counter 152, is equal to or less than 2. If the defrost cycle counter 152 is equal to or less than 2, the method 400 returns to decision block 418 where the method 400 proceeds to blocks 420, 424-438 or 422-438 as previously described. If the defrost cycle counter 152 reports a value greater than 2, the method 400 exits the certification defrost algorithm. It will be appreciated that in alternative embodiments of a method of controlling an HVAC system 100, a block having substantially the same function as block 438 may be configured to determine whether a defrost cycle counter has a value of 0, 1, 3, or any other suitable value instead of a value of 2 as with block 438.

Figure 5:
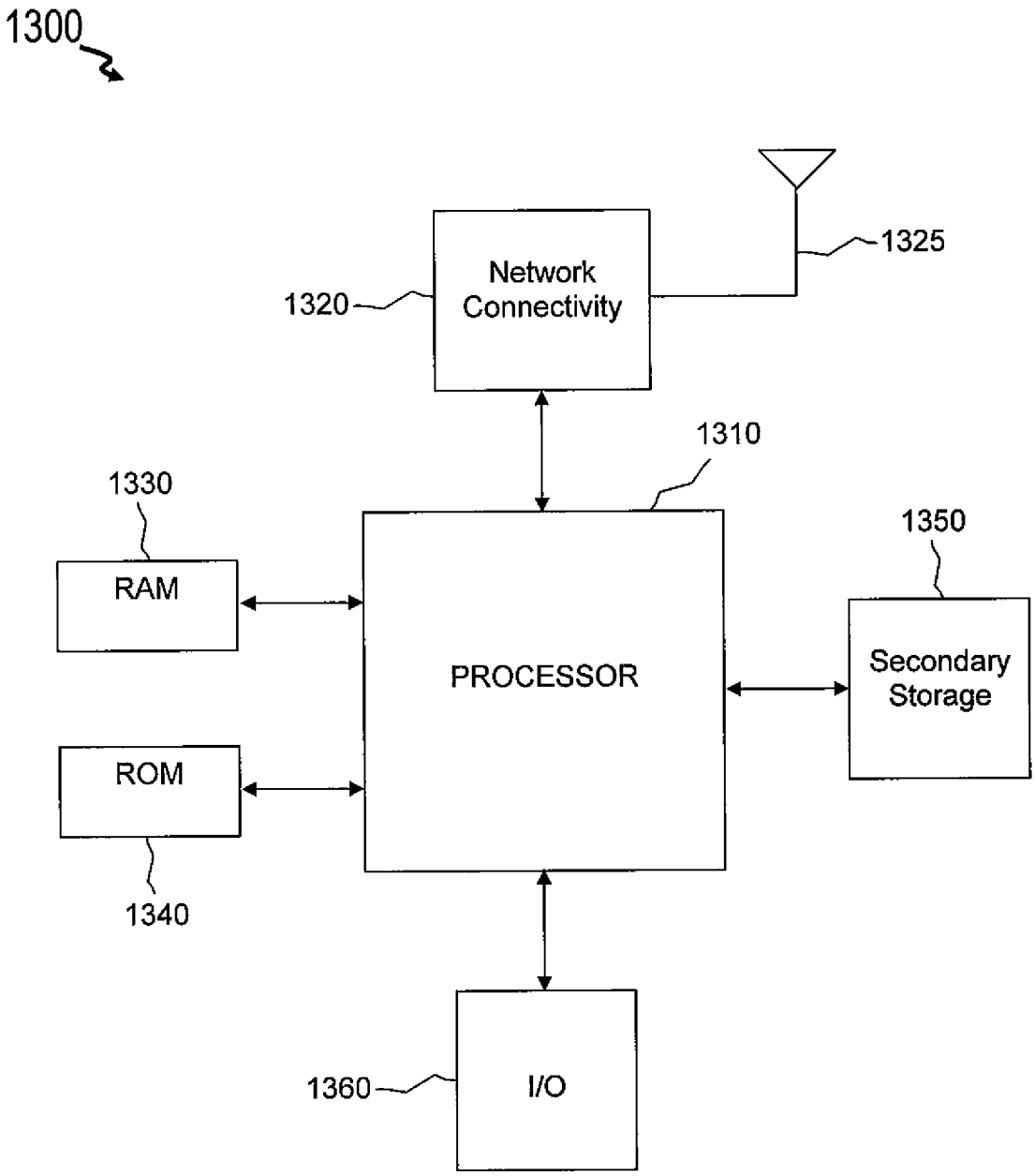
FIG. 5 illustrates a general-purpose processor (e.g., electronic controller or computer) system suitable for implementing the several embodiments of the present disclosure.

Referring now to FIG. 5, the HVAC system 100 described above comprises a processing component (such as processors 132 or 136 shown in FIG. 1) that is capable of executing instructions related to the actions described previously. The processing component may be a component of a computer system. FIG. 5 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor unit or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive such as the personality module 144 shown in FIG. 2). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 1325 might be considered to be a component of the I/O devices 1360 instead of or in addition to being a component of the network connectivity devices 1320. Some or all of the I/O devices 1360 may be substantially similar to various components depicted in the previously described FIG. 1, such as the temperature sensors 142 and 140.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of controlling a heating, ventilation, and air conditioning (HVAC) system, comprising:

executing a field defrost algorithm;

monitoring whether a condition meets a criteria, wherein the condition meeting the criteria comprises an ambient zone temperature being determined to be within a predetermined range;

executing a certification defrost algorithm in parallel with the field defrost algorithm in response to the condition meeting the criteria;

performing a certification defrost cycle if demanded by the certification defrost algorithm;

performing a field defrost cycle if demanded by the field defrost algorithm; and exiting the certification defrost algorithm in response to the field defrost algorithm demanding a field defrost cycle while the ambient zone temperature is determined to be outside the predetermined range;

wherein the predetermined range comprises (1) a low temperature in a range of about 30 degrees Fahrenheit to about 34 degrees Fahrenheit and (2) a high temperature in a range of about 34 degrees Fahrenheit to about 40 degrees Fahrenheit.

2. The method of claim 1, wherein the condition meets the criteria when a compressor has been power cycled.

3. The method of claim 1, wherein the condition meets the criteria when performing a defrost cycle is allowed after having been disallowed.

4. The method of claim 1, wherein the condition meets the criteria when a continuous call for a heating mode has occurred for a predetermined length of time.

5. The method of claim 1, further comprising:

determining whether the HVAC system is operating in a high heating mode or a low heating mode.

6. The method of claim 5, further comprising:

determining whether the high heating mode has been operating for a first predetermined period time if the HVAC system is operating in the high heating mode; and determining whether the low heating mode has been operating for a second predetermined period of time if the HVAC system is operating in the low heating mode.

7. The method of claim 6, wherein the first predetermined period of time is about 135 minutes and the second predetermined period of time is about 375 minutes.

8. The method of claim 6, wherein the first predetermined period of time is within a range of about 90-180 minutes and the second predetermined period of time is within a range of about 240-375 minutes.

9. The method of claim 6, further comprising:

performing a certification defrost cycle if the high heating mode has been operating for the first predetermined period of time; and performing a certification defrost cycle if the low heating mode has been operating for the second predetermined period of time.

10. The method of claim 9, further comprising:

after performing a certification defrost cycle, determining whether the HVAC system is operating in a high heating mode or a low heating mode, determining whether the high heating mode has been operating for a first predetermined period time if the HVAC system is operating in the high heating mode, and determining whether the low heating mode has been operating for a second predetermined period of time if the HVAC system is operating in the low heating mode; and performing another certification defrost cycle if the high heating mode has been operating for the first predetermined period of time and performing another certification defrost cycle if the low heating mode has been operating for the second predetermined period of time.

11. A method of improving an efficiency rating of a heating, ventilation, and air conditioning (HVAC) system during certification comprising:

executing a field defrost algorithm; and selectively executing a certification defrost algorithm in parallel with the field defrost algorithm;

exiting the certification defrost algorithm in response to the field defrost algorithm demanding a field defrost cycle while an ambient zone temperature is determined to be outside a predetermined range;

wherein the predetermined range comprises (1) a low temperature in a range of about 30 degrees Fahrenheit to about 34 degrees Fahrenheit and (2) a high temperature in a range of about 34 degrees Fahrenheit to about 40 degrees Fahrenheit.

12. The method of claim 11, wherein the certification defrost algorithm is executed in response to a monitored condition meeting a criteria.

13. The method of claim 11, wherein the certification defrost algorithm is exited if the monitored condition fails to meet the criteria.

14. The method of claim 11, wherein the monitored condition is an ambient zone temperature.

15. The method of claim 11, wherein the monitored condition is whether a continuous call for a heating mode has persisted for a predetermined length of time.

16. A heating, ventilation, and air conditioning (HVAC) system, comprising:

a controller configured to execute a first algorithm and the controller also being configured to selectively execute a second algorithm while also executing the first algorithm;

wherein each of the first algorithm and the second algorithm are configured to selectively cause operation of the HVAC system in a defrost mode; and exiting the second algorithm in response to the first algorithm demanding operation in the defrost mode while an ambient zone temperature is determined to be outside a predetermined range;

wherein the predetermined range comprises (1) a low temperature in a range of about 30 degrees Fahrenheit to about 34 degrees Fahrenheit and (2) a high temperature in a range of about 34 degrees Fahrenheit to about 40 degrees Fahrenheit.

17. The HVAC system according to claim 16, wherein the controller selectively executes the second algorithm in response to the HVAC system being operated under conditions that indicate that the HVAC system is being tested in an energy efficiency certification environment.

18. The HVAC system according to claim 16, wherein the controller selectively executes the second algorithm in response to an ambient zone temperature being within a predetermined range.

19. The HVAC system according to claim 16, wherein the second algorithm selectively causes operation of the HVAC system in a defrost mode when the HVAC system has been operated in a first heating mode for a first predetermined period;

wherein the second algorithm selectively causes operation of the HVAC system in a defrost mode when the HVAC system has been operated in a second heating mode for a second predetermined period of time; and wherein the first predetermined period of time is different than the second predetermined period of time.

* * * * *

UNITED STATES PATENT AND TRADEMARK OFFICE

CERTIFICATE OF CORRECTION

PATENT NO. : 8,417,386 B2
APPLICATION NO. : 12/272513
DATED : April 9, 2013
INVENTOR(S) : Jonathan D. Douglas et al.

It is certified that error appears in the above-identified patent and that said Letters Patent is hereby corrected as shown below:

On the Title Page, Item (75) Inventors: - "Kristen L. Schaefer" should read "Kristin L. Schaefer"

Signed and Sealed this
Sixteenth Day of December, 2014

Michelle K. Lee

Michelle K. Lee
*Deputy Director of the United States Patent and Trademark Office*